US007147015B1

(12) United States Patent
Durham

(10) Patent No.: US 7,147,015 B1
(45) **Date of Patent: *Dec. 12, 2006**

(54) MANIFOLD FOR RETROFITTING FUEL PUMP STATIONS

(75) Inventor: Rick L. Durham, North Branch, MN (US)

(73) Assignee: Graffco, Inc., Forest Lake, MN (US)

( * ) Notice: Subject to any disclaimer, the term of this patent is extended or adjusted under 35 U.S.C. 154(b) by 98 days.

This patent is subject to a terminal disclaimer.

(21) Appl. No.: 11/062,889

(22) Filed: Feb. 22, 2005

Related U.S. Application Data

(60) Provisional application No. 60/546,618, filed on Feb. 20, 2004.

(51) Int. Cl.
*B65B 1/04* (2006.01)

(52) U.S. Cl. ..... 141/105; 141/59; 141/302; 222/144.5

(58) Field of Classification Search ..... 141/2, 141/4, 5, 9, 59, 67, 100–107, 206, 302, 98, 141/382, 392; 137/3, 88, 93, 111, 112; 222/25, 222/144.5
See application file for complete search history.

(56) References Cited

U.S. PATENT DOCUMENTS 4,310,762 A 1/1982 Boyer et al.
4,876,653 A * 10/1989 McSpadden et al. ..... 700/239
D309,144 S 7/1990 Austin et al.
4,978,029 A 12/1990 Furrow et al.
5,651,478 A 7/1997 Tatsuno
5,921,263 A * 7/1999 Negley, III ..... 137/3
6,041,965 A * 3/2000 Smith ..... 222/25
6,085,775 A 7/2000 Smith
6,223,788 B1 5/2001 Taylor
6,557,733 B1 5/2003 Durham

FOREIGN PATENT DOCUMENTS

EP 1010664 6/2000

* cited by examiner

*Primary Examiner*—Timothy L. Maust
(74) *Attorney, Agent, or Firm*—Gray, Plant, Mooty, Mooty & Bennett, PA; Peter Forrest

(57) ABSTRACT

A manifold system for retrofitting an electronically controlled, multi-product, multi-hose fuel pump station into an electronically controlled multi-product, single-hose fuel pump station. The manifold system includes multiple partial manifolds that are connected by piping. The system enables connection of at least two existing independent input lines of distinct fuel grades to a common outlet, which is connected to a single existing fueling point Respective fuel grade switches select a fuel grade for delivery from the existing fueling point. An electronic controller ensures that only the selected grade of fuel passes through the outlet of the manifold to the existing fueling point.

9 Claims, 11 Drawing Sheets

MANIFOLD FOR RETROFITTING FUEL PUMP STATIONS

CROSS-REFERENCE TO RELATED APPLICATION

This application claims the benefit of provisional application No. 60/546,618 filed Feb. 20, 2004, to which it is entitled under 35 U.S.C. § 119(e)(3) because Feb. 20, 2005 was a Sunday and Monday, Feb. 21, 2005 was a Federal holiday (Presidents Day) within the District of Columbia.

TECHNICAL FIELD

This invention concerns retrofitting of electronically controlled, multi-product, multi-hose fuel pump stations, such as the gasoline "pumps" commonly used by consumers.

BACKGROUND

From an engineering standpoint, commercially popular, electronically controlled, multi-product, multi-hose fuel pump stations are just multiple independent single-product systems within a common housing. For example, in a very common configuration, multiple grades of gasoline are dispensed on each of the two sides of a pump station.

There are as many hose/handle combinations on each side of the pump station as there are grades of gasoline available on each side. There are actually six relatively independent gasoline delivery systems housed within the single pump station. There are a variety of reasons to retrofit multi-product, multi-hose gasoline pump stations to single-hose pump stations capable of dispensing the same number and types of gasoline products. Reducing the number of hoses, nozzles, and other parts provides economic benefits (such as reduction in the overall cost of purchase of refurbished pumps and reduction in maintenance costs); environmental benefits (such as reduction in the number of potential liquid and vapor leakage points, and the ability to recycle older equipment to more modern environmental standards); operational improvements (such as reduction in confusion by simplification of product selection at the pump station); and so on.

DISCLOSURE OF INVENTION

The invention is a manifold system for retrofitting an electronically controlled, multi-product, multi-hose gasoline pump station into an electronically controlled multi-product, single-hose gasoline pump station. The invention can be installed on a variety of existing electronically controlled, multi-product, multi-hose gasoline pump stations. Use of the invention provides significant cost savings compared to the cost of a new single-hose pump station.

DESCRIPTION OF THE FIGURES

The Figures are schematic and therefore only examples of possible configurations of the invention. In particular, dimensions shown on the Figures are for illustration only except as specifically noted.

DETAILED DESCRIPTION

Figure 1:
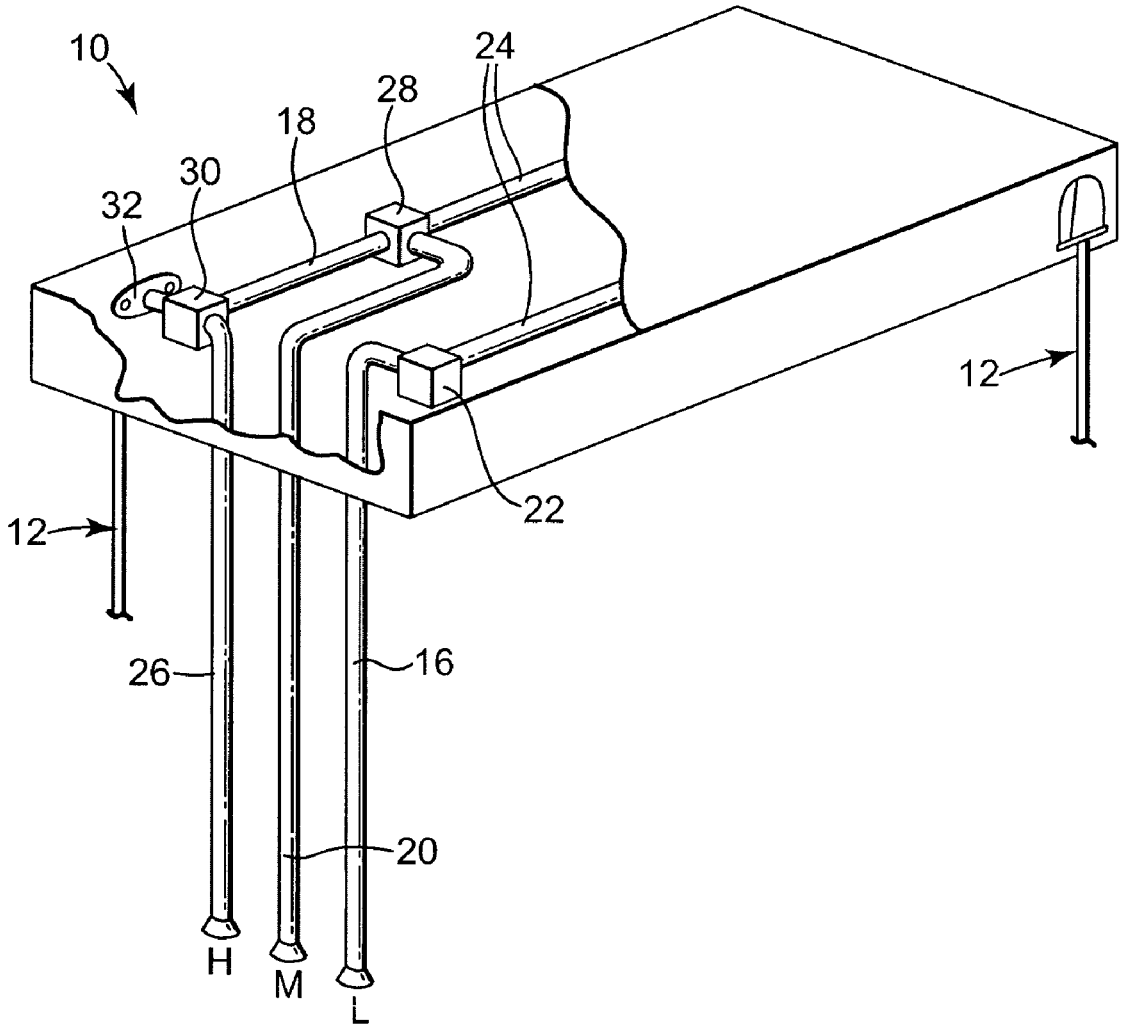
FIG. 1 is a schematic view of the piping configuration aspect of the invention.

FIG. 1 is a schematic view of the piping configuration aspect of the invention. This configuration shows the result of applying the invention to a gasoline pump station 10 (sometimes called a "dispenser" or "pump"), the upper portion of which is partially shown. The station formerly had multiple (typically two or three) distinct grades of gasoline (denoted H, M, and L only by way of example), and a like number of dedicated hoses on each of the two longest sides. The result of the conversion is a pump 10 in which either of the two dedicated hose/handle combinations which connect to pump 10 at fueling points 12 may independently dispense any of the multiple grades of gasoline. Connecting more than one grade of gasoline to a single outlet reduces the number of connections required, thus reducing the number of potential gasoline leaks from the piping.

Because the two sides of pump 10 are identical, the remainder of this discussion involves only a single side, with the understanding that it would be repeated for the other side of the pump. Similarly, while the principles of the invention are applicable to any number of grades of gasoline, three grades will be assumed only for convenience in the remainder of this discussion.

Three existing independent lines 16, 20 and 26 from existing dedicated pumps and underground tanks (not shown) supply the three grades of gasoline. Each of a set of three manifolds 22, 28 and 30 has an inlet port for connection to one of the three existing gasoline lines 16, 20, and 26 (respectively) on either end of pump 10. Between adjacent pairs of manifolds are lines 18 and 24 that are installed when manifolds 22, 28 and 30 are installed to retrofit the pump station 10. Due to the construction of each manifold 22, 28 and 30 as discussed in more detail below, each grade of gasoline from existing lines 16, 20, and 26 is ultimately connected to left manifold 30, which connects by way of flange 32 to fueling point 12. Thus, a single fueling point 12 can dispense any of the three grades of gasoline delivered from existing lines 16, 20, and 26.

Figure 2A:
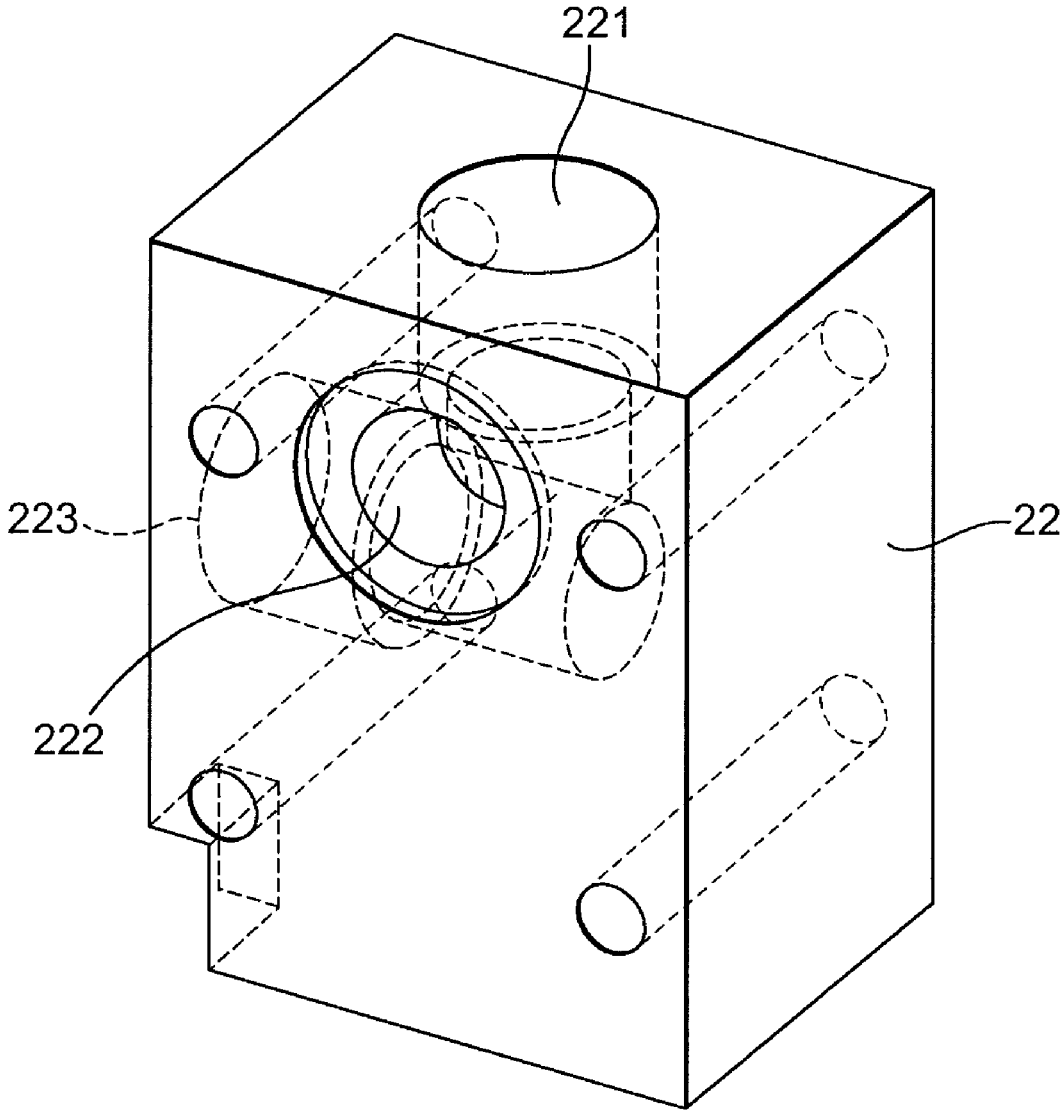
FIGS. 2A–2F are detailed views of portions of the piping configuration shown in FIG. 1.
Figure 2B:
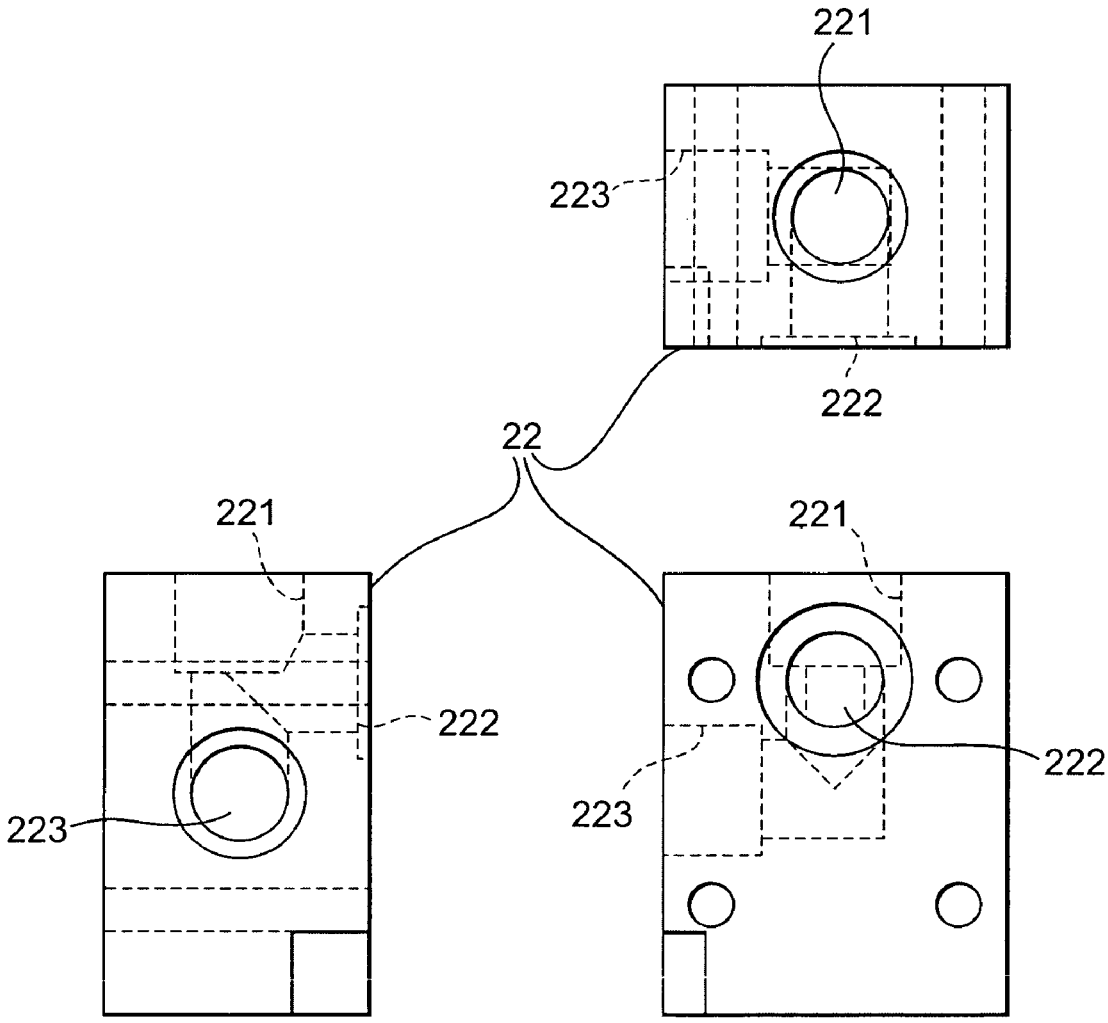
Figure 2C:
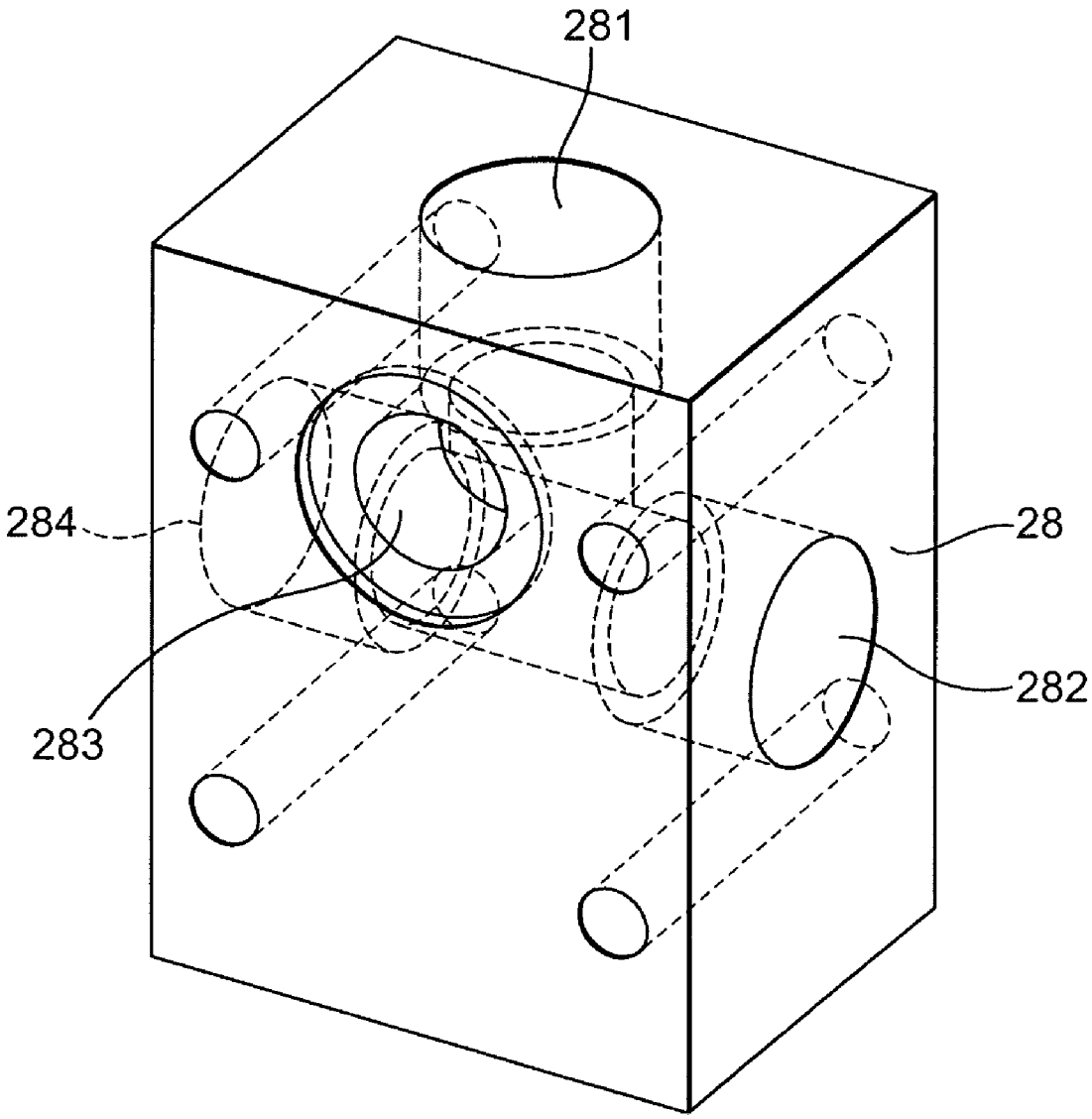
Figure 2D:
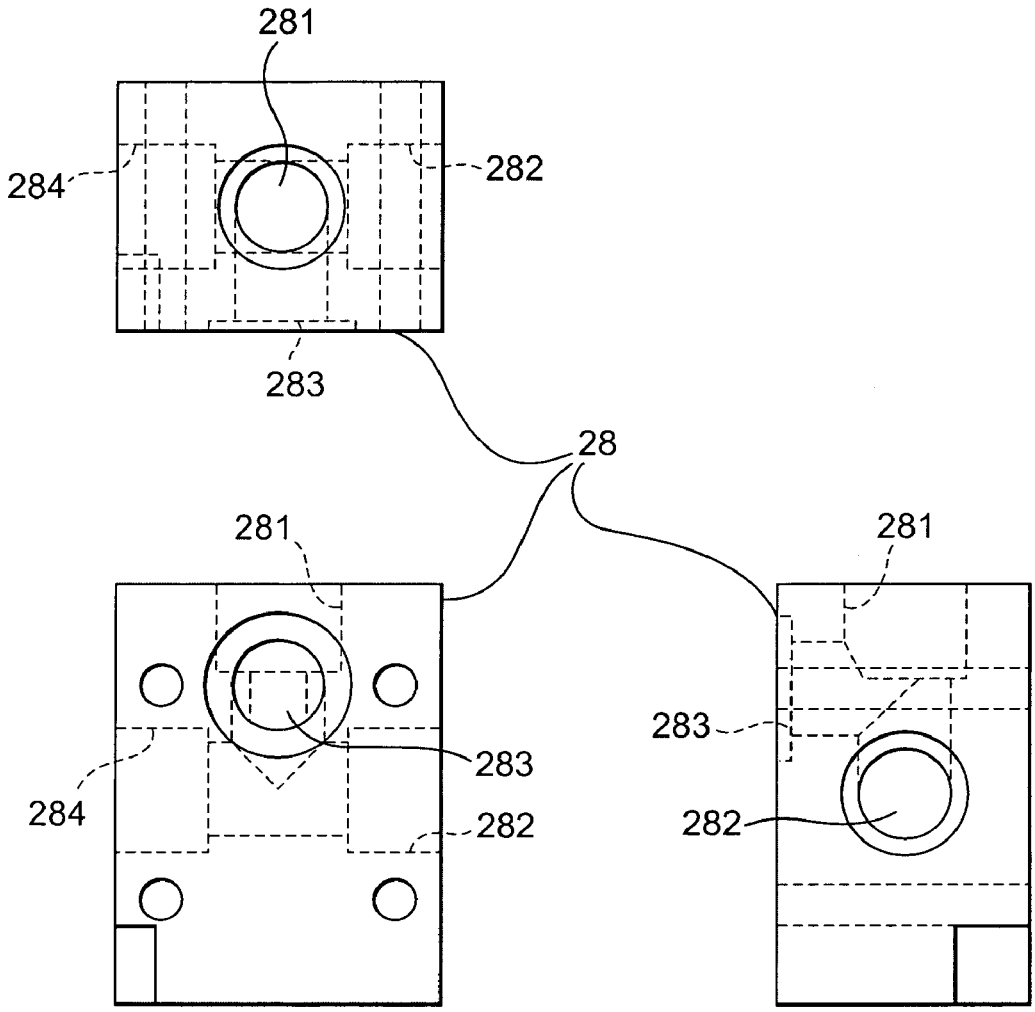
Figure 2E:
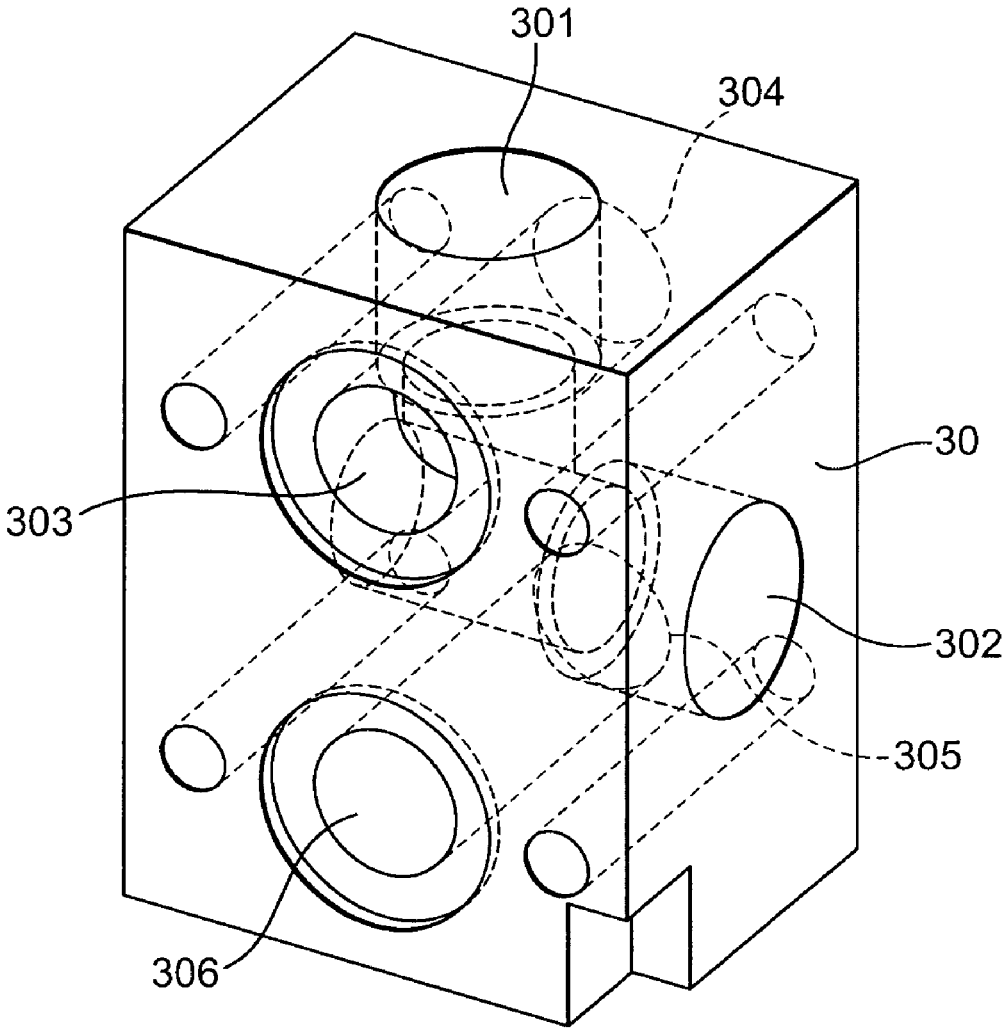
Figure 2F:
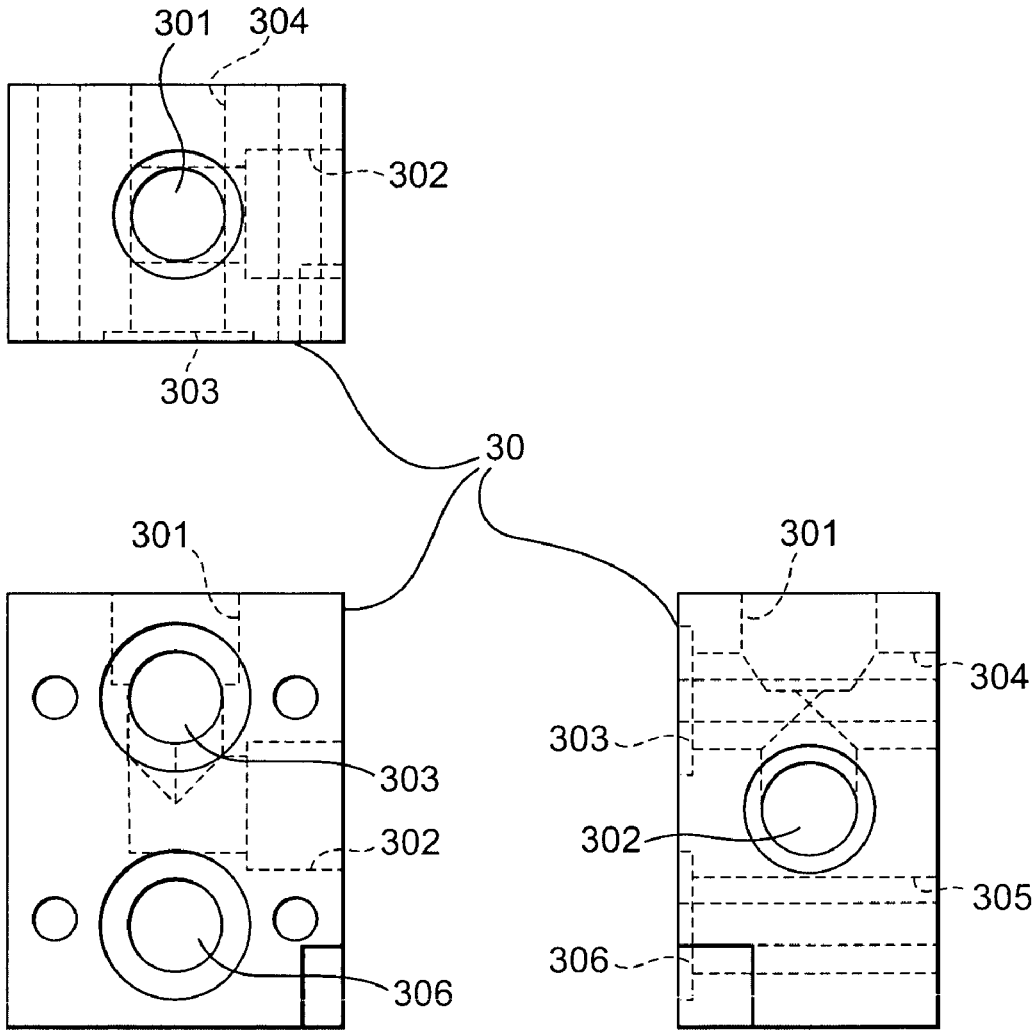

FIGS. 2A–2F are schematic views of details of manifolds 22 (FIGS. 2A and 2B), 28 (FIGS. 2C and 2D), and 30 (FIGS. 2E and 2F). The dimensions and other details shown in FIGS. 2B, 2D, and 2F are not critical to the invention except as specified in the claims. The exact configuration of each manifold would depend on constraints imposed by the dimensions, clearances, and the like within pump 10 prior to retrofitting it with the invention. In particular, each of manifolds 22, 28, and 30 includes four mounting holes that extend through the entire manifold. Such holes are preferred but not required, and when present the number, size, location and other aspects of the mounting holes may be modified without affecting the scope of the invention. While the connections between the manifolds 22, 28 and 30 and lines 18 and 24 are shown to be threaded in FIGS. 2A–2F, it is preferred that such connections be flanged like the connections between the manifolds 22, 28 and 30 and the existing lines 16, 20, and 26.

The functions of the ports in each of the preferred configurations of manifolds 22, 28, and 30 are summarized in Table 1 below. "Milling Access" means a port created to provide access to mill out the interior of the manifold. Such ports are not used for any other purpose and therefore embodiments of the invention that do not require milling access are also possible. When ports for milling access are present, however, they are threaded to accept a plug during use of the invention, or otherwise plugged in any convenient manner. "Vapor Return" refers to an input for a fuel vapor return from fuel point 12 when such a vapor control system is used, although for clarity the piping associated with such a system is not shown in the Figures. Such systems are common and even mandatory in many jurisdictions.

TABLE 1

| Manifold | Port | Function |
|---|---|---|
| Right (22) | 221 | Milling Access |
| | 222 | Fuel input from existing L grade line 16 |
| | 223 | L grade fuel output to piping 24 |
| Center (28) | 281 | Milling Access |
| | 282 | L grade fuel input from piping 24 |
| | 283 | M grade fuel input from line 20 |
| | 284 | L or M grade fuel output to piping 18 |
| Left (30) | 301 | Milling Access |
| | 302 | L or M grade fuel input from piping 18 |
| | 303 | H grade fuel input from line 26 |
| | 304 | L, M, or H grade fuel output to fuel point 12 |
| | 305 | Vapor Return input |
| | 306 | Vapor Return output |

In general, the preferred piping for the lines 18 and 24 of the invention is type L soft-wall annealed copper tubing having an outside diameter of ⅞ths inches, a wall thickness of 0.045 inches, a working pressure of 510 psi, and a burst pressure of 3100 psi at 150 degrees Fahrenheit. However, these are only examples and not limitations on the scope of the invention. Regardless of the tubing specifications chosen, the preferred configuration is for the tubing to be bent as little as possible (ideally, not at all) and otherwise assembled to connect to existing lines for each grades of gasoline. Various conventional flare nuts, union connections, gaskets and the like are used to connect piping in the conventional manner. It is preferred to include a flange like flange 32 on each end of line 18 and also on each end of line 24, and to use appropriate gaskets, O-rings or the like.

Figure 3:
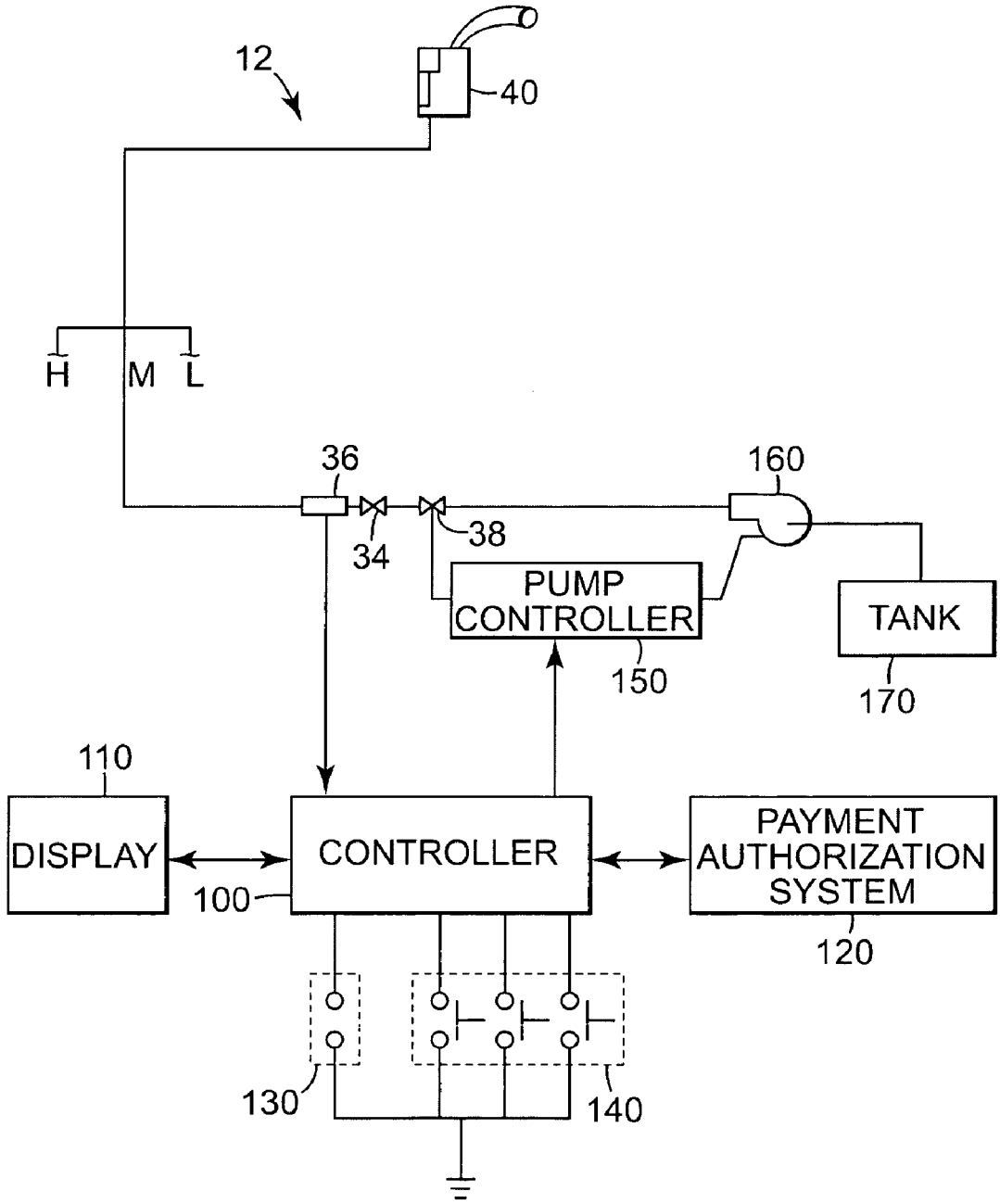
FIG. 3 is a schematic diagram of the overall configuration of the invention.

FIG. 3 is a schematic diagram of the overall configuration of the invention as applied to a single grade of fuel, grade M, for illustrative purposes only. Controller 100 is connected to display 110, conventional payment authorization system 120, pump on/off master switch 130, and grade selection switches (one per grade) indicated collectively as 140. When a transaction has been properly authorized and the appropriate selection of fuel grade has been made, controller 100 signals pump controller 150 to activate pump 160 to remove the appropriate grade of fuel from underground tank 170, and to open solenoid valve 38 to allow that grade of fuel to flow to fueling point 12 and thus to nozzle 40.

To prevent cross-contamination of different grades of gasoline at a single fueling point 12, a conventional spring-loaded check valve with pressure relief 34 may be provided at an inlet of a metering device 36 downstream of the solenoid valve 38. The pressure relief portion of each check valve 34 allows fuel expansion to be relieved when pressure ahead of the valve exceeds a given value. The spring portion of each check valve is normally closed so that there is positive closure when the fuel flow has ceased. While it is possible to implement the invention without any check valves, compliance with weights and measures regulations generally requires that the grades of gasoline having the highest octane rating not be contaminated with lower octane grades. Thus, a single check valve would be placed in the H line to prevent this from happening. The most preferred embodiment is to place a check valve in each line, e.g., H, M, and L. It is possible but not required to incorporate check valves into any of manifolds 22, 28 and 30 themselves.

Switches 140 are preferably combined into a single membrane switch unit that employs non-tactile membrane switches. The entire unit should have an overlay designed to withstand extreme ambient temperature variations, because the overlay is located on the exterior of the pump and thus exposed to year-round weather. The membrane switch unit preferably has an adhesive backing that can adhere to metal. The overlay typically includes instructive lettering or symbols to instruct the consumer how to select their desired grade of gasoline and start the pump.

Figure 4:
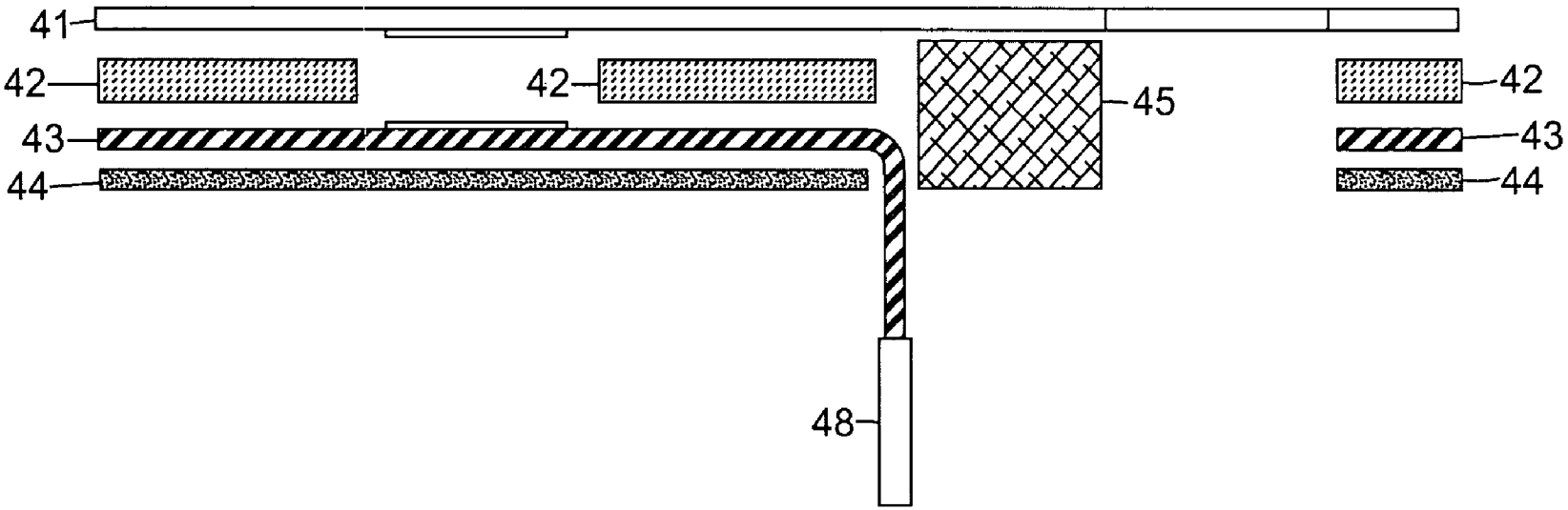
FIG. 4 is a schematic exploded cross section of a component of the invention.

FIG. 4 is a schematic exploded cross section of a preferred embodiment of a membrane switch unit. Graphic layer 41 is preferably 0.007 inch thick polyester; spacer layer 42 is preferably a 0.005 inch thick adhesive/polyester/adhesive laminate; static layer 43 is preferably 0.005 inch thick polyester; static adhesive layer 44 is preferably 0.002 inch thick; tail filler layer 45 is preferably 0.012 inch thick laminate made up of portions of layers 41, 42, and 43; and connector 46 is preferably a flexible electrical connector having housings, pins, and the like as needed, such as Nicomatic OF-02 (quantity 2) and Nicomatic 10025-12 (quantity 2), respectively.

Figure 5:
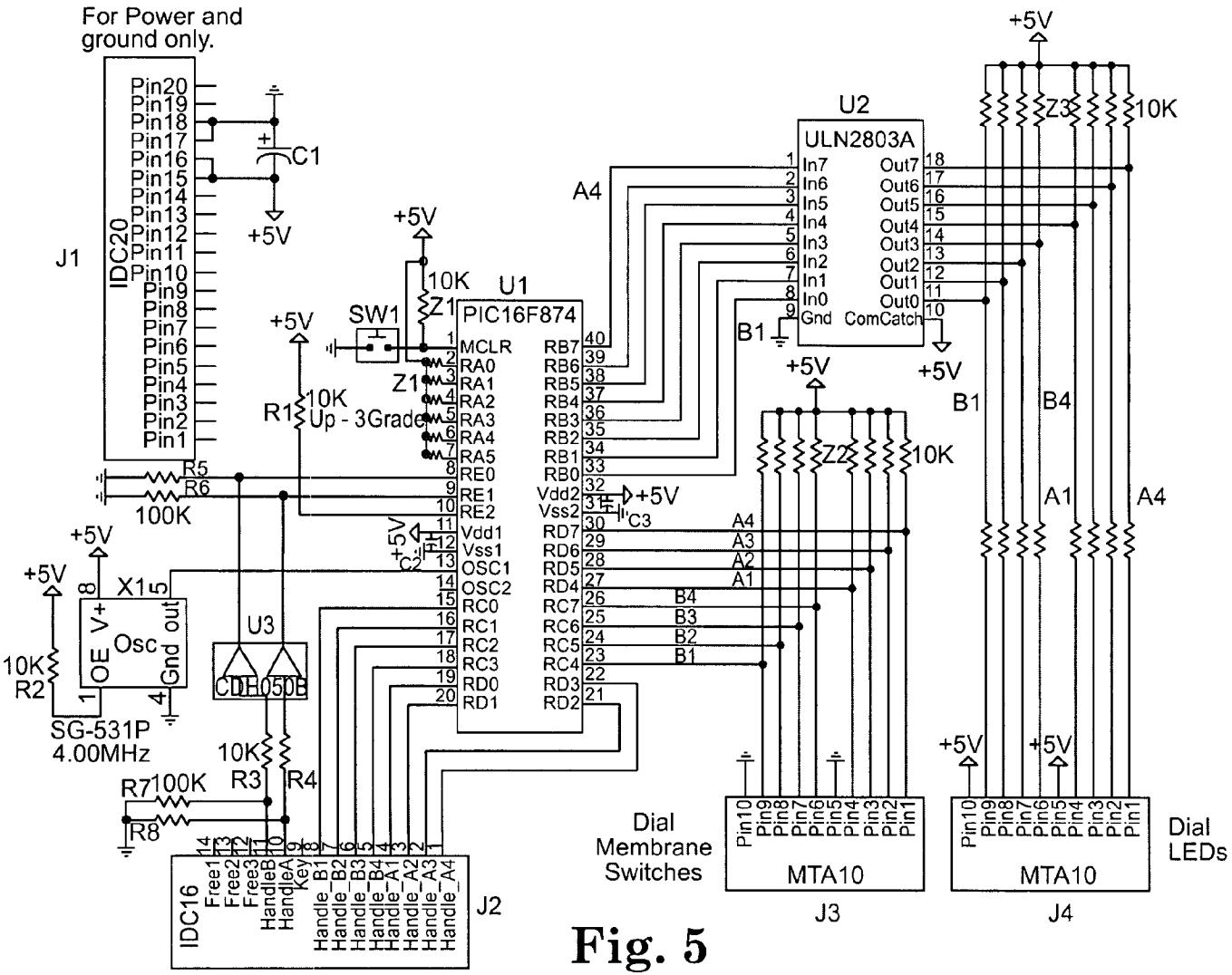
FIG. 5 is a schematic diagram of the electronics aspect of the invention.

While the scope of the invention is not limited to a particular electronic configuration or design, FIG. 5 is a schematic diagram of a preferred embodiment of the electronics aspect of the invention, in which the following components (or their equivalents) are employed:

TABLE 2

| Part | Manufacturer and Part Number | Description |
|---|---|---|
| U1 | Microchip PIC16F877-04/P | CPU, Flash |
| U2 | Allegro ULN2803A | Driver |
| U3 | Fairchild Semi CD4050BCN | Buffer, Hex |
| X1 | Epson SG-531P-4.0000M | Oscillator |
| SW1 | — | Switch, Pushbutton |
| C1 | Panasonic ECE-A1EU101 | Capacitor, 100 uF, 25 V |
| C2–3 | BC Components A334M20Z5UFVVWW | Capacitor, 0.33 uF, 50 V |
| R1–4 | Yageo | Resistor, 10K, 1/4 W |
| R5–8 | Yageo | Resistor, 100K, 1/4 W |
| J1 | 3M 2520-5002UB | Connector, 20 Pin |
| J2 | 3M 2516-5002UB | Connector, 16 Pin |
| J3–4 | Amp 1-640457-0 | Header, 10 Pin, MTA |
| Z1 | Bourns 4608X-1-103 | SIP-8, 10K, Bussed |
| Z2–3 | Bourns 4610X-1-103 | SIP-10, 10K, Bussed |
| Z4 | Bourns 4116R-1-TBD | DIP-16, TBD, Isolated |
| — | Assmann A40-LC-TT | Socket, 40 Pin DIP |

In general terms, this aspect of the invention is preferably embodied in a pump handle interface board that includes a printed circuit board having an on-board (preferably, but non necessarily, pre-programmed) micro-controller. The interface board includes cables connected to the nozzle handle switches and the grade selection membrane switches. The interface board must fit in the circuit board cage of an existing pump station. The micro-controller (preferably, but not necessarily, pre-programmed) includes source code designed to interpret the handle and grade selection inputs; source code designed to receive and send signals to the existing dispenser controller board.

An optional additional feature is a built-in timer for delaying activation of the solenoid valves by (preferably)

one to fifteen seconds, to prevent inadvertent tripping of the mechanical leak detection system. Mechanical leak detectors are designed to stop the flow of gasoline when the fuel line pressure drops below a given value. This can occur when temperature variations cause thermal contraction of the gasoline in the line. It can also occur when the pressure in the gasoline hose drops upon initialization of the dispenser. Delaying opening of the solenoid valves prevents inadvertent tripping of the mechanical leak detectors.

The conventional input/output cable intercepts existing pump handle inputs and outputs, and redirects these signals to the handle interface board. Similarly, conventional flat flexible cables connect all non-tactile membrane switches to the handle interface board.

Figure 6:
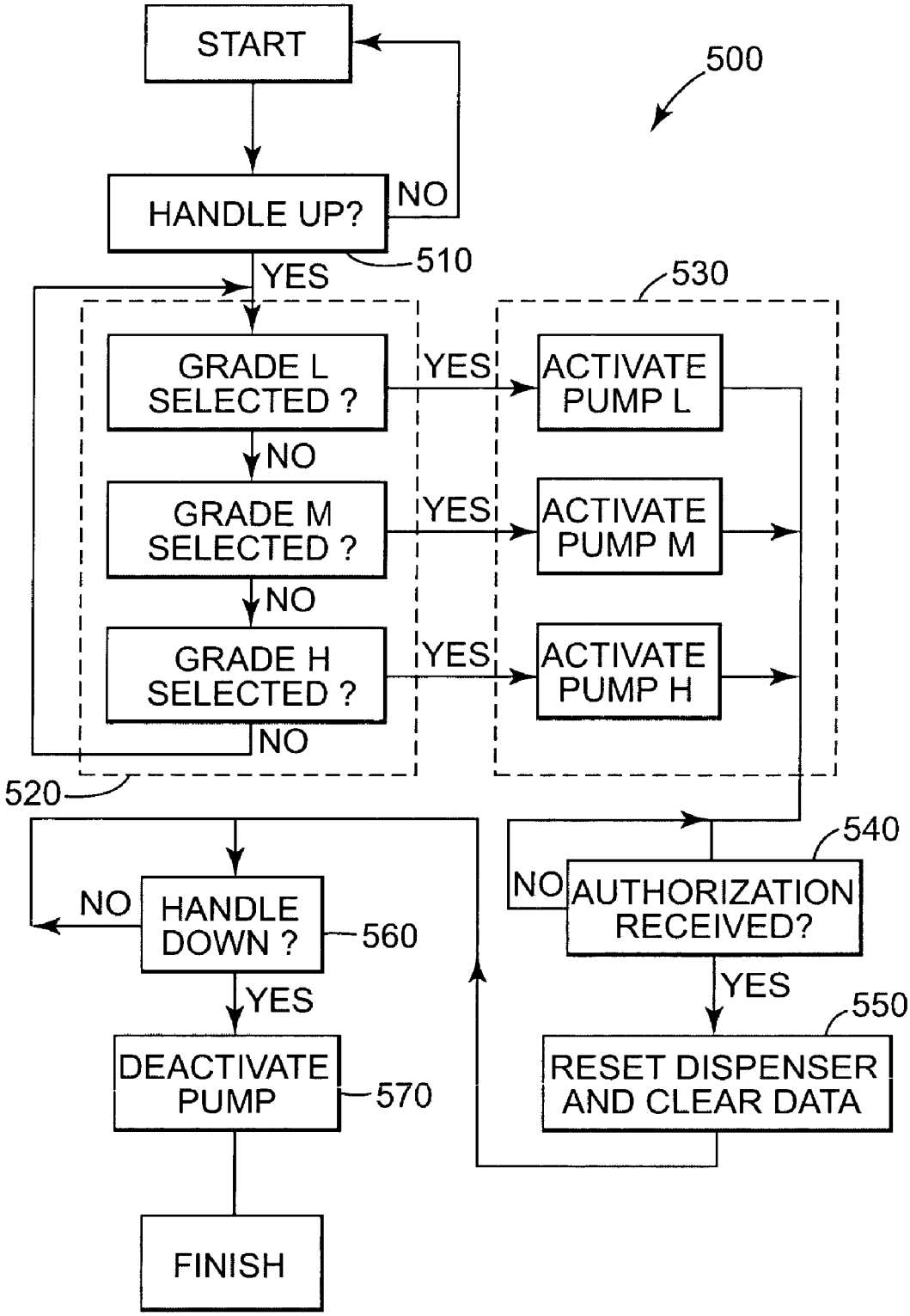
FIG. 6 is a schematic flowchart of the process aspect of the invention.

FIG. 6 is a schematic flow chart of the overall process 500 by which the invention operates once pump station 10 has been retrofitted. At 510, by raising the dispenser handle, the consumer signals to the handle interface board the beginning of a dispensing sequence. The consumer selects the grade of fuel desired at 520, and a signal to that effect is received at the handle interface board, then sent at 530 to the existing dispenser controller 150 (FIG. 3). At 540, an authorization signal is received for the fueling sequence from the control console. At 550, the dispenser resets and, if not already done, clears data from the previous transaction remaining on the display. The consumer dispenses the desired amount of fuel, then returns the handle to the cradle at 560 and 570, and completes the sale according to whatever other options may be desired. Optional variations on this process include controlled delays in either or both of the opening and closing of the valves as directed by the micro-controller.

To retrofit the inventive system into an electronically controlled, multi-product, multi-hose gasoline pump station, the following general procedure is preferred: remove exterior access panels to access the interior of the pump station assembly; disconnect the meter inlet flanges; insert check valves into each existing line; remove existing piping; connect the piping of the inventive system; remove the existing hanging hardware and plug the existing outlets; remove the nozzle boot assemblies; mount the nozzle boot kits; and open the bezel and insert the circuit board into the existing card cage, then connect the cables and other wiring.

I claim:

1. A system for retrofitting an existing electronically controlled, multi-grade, multi-hose fuel pump station into an electronically controlled multi-grade, single-hose fuel pump station, in which the existing pump station comprises fueling points, pump controllers, and metering devices for each of a respective number of distinct fuel grades; the system comprising in combination:

a set of manifolds connecting at least two existing independent input lines of the distinct filet grades to a common outlet, the common outlet being connected to a single existing fueling point;

respective fuel grade selection switches for selecting a fuel grade for delivery from the single existing fueling point; and an electronic controller which receives signals from the grade selection switches and authorizes activation of the respective pump controller corresponding to a selected grade of fuel, such that only the selected grade of fuel passes through the outlet of the manifold to the existing fueling point.

2. The system of claim 1, further comprising at least one check valve located in an existing input line for a fuel grade.

3. The system of claim 2, in which the check valve is located upstream of the metering device for the respective fuel grade.

4. The system of claim 2, in which there is a check valve in cach existing input line.

5. The system of claim 1, in which there are three existing independent input lines of distinct fuel grades.

6. The system of claim 1, further comprising a display that incorporates the respective fuel grade selection switches.

7. The system of claim 1, further comprising a master on/off switch, and in which the electronic controller receives a signal from the master on/off switch prior to activation of the respective pump controller.

8. The system of claim 1, in which the set of manifolds comprises:

a first manifold connecting an existing input line of low grade fuel to a first pipe;

a second manifold connecting an existing input line of medium grade fuel and the first pipe to a second pipe; and a third manifold connecting an existing input line of high grade fuel and the second pipe to the common outlet.

9. The system of claim 8, in which the third manifold further comprises a vapor return input and a vapor return outlet.

* * * * *